US010531742B2

(12) United States Patent
Reed

(10) Patent No.: US 10,531,742 B2
(45) Date of Patent: Jan. 14, 2020

(54) VERSATILE, PORTABLE FOLDABLE CHAIR

(71) Applicant: Spencer M. Reed, Spring Valley, CA (US)

(72) Inventor: Spencer M. Reed, Spring Valley, CA (US)

( * ) Notice: Subject to any disclaimer, the term of this patent is extended or adjusted under 35 U.S.C. 154(b) by 0 days.

(21) Appl. No.: 15/000,671

(22) Filed: Jan. 19, 2016

(65) Prior Publication Data

US 2017/0202355 A1 Jul. 20, 2017

(51) Int. Cl.

| | |
|---|---|
| ***A47C 4/00*** | (2006.01) |
| ***A47C 7/00*** | (2006.01) |
| ***A47C 3/34*** | (2006.01) |
| *A47C 4/28* | (2006.01) |

(52) U.S. Cl.

CPC ..... *A47C 7/008* (2013.01); *A47C 3/34* (2013.01); *A47C 4/286* (2013.01)

(58) Field of Classification Search

None

See application file for complete search history.

(56) References Cited

U.S. PATENT DOCUMENTS 398,943 A * 3/1889 Crandall ..... A47C 4/286 297/45
703,077 A * 6/1902 Nivison ..... A61G 5/08 297/44
815,507 A * 3/1906 Bradley ..... F16M 11/00 248/164
1,027,692 A * 5/1912 Cole ..... A47C 4/286 248/164
1,268,631 A * 6/1918 Schaeffer ..... A47C 4/10 297/54
1,627,388 A * 5/1927 Hayes ..... A47C 4/283 297/145
1,795,911 A * 3/1931 Walker ..... A47C 4/283 248/436
1,882,585 A * 10/1932 Hayes ..... A47C 4/283 248/436
1,942,112 A * 1/1934 McQuilkin ..... A47C 4/286 297/45
2,518,971 A * 8/1950 Zillig ..... A47C 1/16 297/350
2,581,793 A * 1/1952 Hill ..... A47C 4/283 297/461

(Continued)

*Primary Examiner* — Kyle J. Walraed-Sullivan
(74) *Attorney, Agent, or Firm* — John R. Ross, III; John R. Ross

(57) ABSTRACT

A portable, folding chair. Two front leg supports are pivotally connected to a seat frame and extend downward from the seat frame. Two rear leg supports are also pivotally connected to the seat frame. A majority of the length of each rear leg support is positioned above the seat frame. Two individually adjustable front legs extend downward from the front leg supports and two individually adjustable rear legs extend downward from the rear leg support. A front foldable leg brace is connected between the two front leg supports and a rear foldable leg brace is connected between the two rear leg supports. In preferred embodiments, the chair may be utilized in a variety of seating arrangements, such as: bleacher seating, concrete stadium seating, slope seating, flat surface seating and uneven surface seating.

13 Claims, 11 Drawing Sheets

(56) References Cited

U.S. PATENT DOCUMENTS 2,608,240 A * 8/1952 Booth ..... A47C 4/283 248/436
2,647,563 A * 8/1953 Bishop ..... A47C 1/16 297/350
2,713,385 A * 7/1955 McQuilkin ..... A47C 4/286 297/45
4,014,591 A * 3/1977 Gittings ..... A47C 4/286 297/55
4,065,173 A * 12/1977 Gittings ..... A47C 4/283 297/45
4,105,244 A * 8/1978 Colby ..... A47C 4/283 297/440.11
4,243,263 A * 1/1981 Thiboutot ..... A47C 4/286 297/42
4,245,849 A * 1/1981 Thiboutot ..... A47C 4/286 248/436
5,058,950 A * 10/1991 Mann ..... A47C 4/286 297/16.2
5,570,928 A * 11/1996 Staunton ..... A47C 4/283 297/232
6,082,813 A * 7/2000 Chen ..... A47C 4/286 297/16.1
6,170,907 B1 * 1/2001 Tsai ..... A47C 1/12 297/16.1
6,454,348 B1 * 9/2002 Wu ..... A47C 4/286 297/16.2
6,601,912 B1 * 8/2003 Chen ..... A47C 4/286 297/38
6,634,705 B1 * 10/2003 Zheng ..... A47C 4/286 297/41
6,752,414 B1 * 6/2004 Waldron ..... A47C 4/286 280/47.4
6,840,574 B1 * 1/2005 Wu ..... A47C 4/20 297/188.14
7,073,852 B1 * 7/2006 Zheng ..... A47C 4/286 297/16.2
7,334,837 B1 * 2/2008 Long ..... A01M 31/02 297/16.2
7,717,503 B1 * 5/2010 Watson ..... A47C 4/286 297/16.2
8,864,222 B2 * 10/2014 Grace ..... A47C 4/286 297/35
9,314,100 B1 * 4/2016 Logan ..... A47C 1/14
9,510,683 B1 * 12/2016 Sharp ..... A47C 7/008
2004/0207236 A1 * 10/2004 Chen ..... A47C 4/42 297/45
2007/0046077 A1 * 3/2007 Fang ..... A47C 3/34 297/130
2009/0206226 A1 * 8/2009 Forrest ..... A47B 91/02 248/354.6
2009/0230735 A1 * 9/2009 Chen ..... A47C 4/286 297/16.1
2010/0013274 A1 * 1/2010 Chen ..... A47C 4/286 297/42
2010/0164256 A1 * 7/2010 Salisbury ..... A47C 7/744 297/16.2
2010/0207429 A1 * 8/2010 Quinn ..... A45B 11/00 297/16.1
2010/0237664 A1 * 9/2010 Grace ..... A47C 4/286 297/16.2
2010/0237665 A1 * 9/2010 Grace ..... A47C 4/286 297/16.2
2010/0314914 A1 * 12/2010 Mazzola ..... A47C 3/34 297/16.2
2011/0006564 A1 * 1/2011 Lougee ..... A47C 4/286 297/41
2011/0006565 A1 * 1/2011 Lougee ..... A47C 4/286 297/59
2011/0018312 A1 * 1/2011 Grace ..... A47C 4/286 297/16.2
2011/0298263 A1 * 12/2011 Bateman ..... A47C 7/402 297/338
2013/0026799 A1 * 1/2013 Miller ..... A47C 4/46 297/19
2013/0292971 A1 * 11/2013 Larson ..... A47B 83/02 297/173
2014/0097647 A1 * 4/2014 Grace ..... A47C 3/0255 297/42
2014/0339859 A1 * 11/2014 Holland ..... A47C 3/34 297/19
2015/0042144 A1 * 2/2015 Frankel ..... A47C 1/14 297/423.3
2015/0090704 A1 * 4/2015 Smith ..... A47C 7/748 219/217
2015/0265054 A1 * 9/2015 Choi ..... A47C 1/024 297/45
2015/0313364 A1 * 11/2015 Miller ..... A47C 4/04 297/19
2015/0359339 A1 * 12/2015 Choi ..... A47C 4/286 297/35
2016/0100688 A1 * 4/2016 Grace ..... A47C 4/286 297/17
2016/0296022 A1 * 10/2016 Le ..... A47C 4/286
2016/0296023 A1 * 10/2016 Choi ..... A47C 4/286
2016/0353727 A1 * 12/2016 Ruybal ..... A01K 97/22

* cited by examiner

VERSATILE, PORTABLE FOLDABLE CHAIR

The present invention relates to chairs, and in particular, to portable, foldable chairs.

BACKGROUND OF THE INVENTION

Portable, foldable chairs are known in the prior art. It is very common for individuals and families to carry portable, foldable chairs with them on outings, such as a day at the beach, a picnic, a Saturday soccer game, or a stadium or arena sports event. Common prior art chairs are easily folded for transport and may be easily unfolded and set up outdoors as desired. However, the prior art chair is unsuited for usage in an arena or stadium where there are bleachers or concrete stadium seating. The consumer is then forced to buy (at no small expense) another portable chair specifically designed so that it can be placed on the bench portion of bleachers or onto a concrete stadium seat. These special chairs are usually very flat and resemble a pad with a backrest attached. There is currently no option available to the consumer for a chair that will allow the consumer to be comfortably seated in all types of seating situations. For example, there is currently no portable, foldable chair that can be used for: bleacher seating, concrete stadium seating, slope seating, flat surface seating and uneven surface seating.

What is needed is a better, more versatile, portable foldable chair.

SUMMARY OF THE INVENTION

The present invention provides a portable, folding chair. Two front leg supports are pivotally connected to a seat frame and extend downward from the seat frame. Two rear leg supports are also pivotally connected to the seat frame. A majority of the length of each rear leg support is positioned above the seat frame. Two individually adjustable front legs extend downward from the front leg supports and two individually adjustable rear legs extend downward from the rear leg support. A front foldable leg brace is connected between the two front leg supports and a rear foldable leg brace is connected between the two rear leg supports. In preferred embodiments, the chair may be utilized in a variety of seating arrangements, such as: bleacher seating, concrete stadium seating, slope seating, flat surface seating and uneven surface seating.

DETAILED DESCRIPTION OF THE PREFERRED EMBODIMENTS

Figure 1:
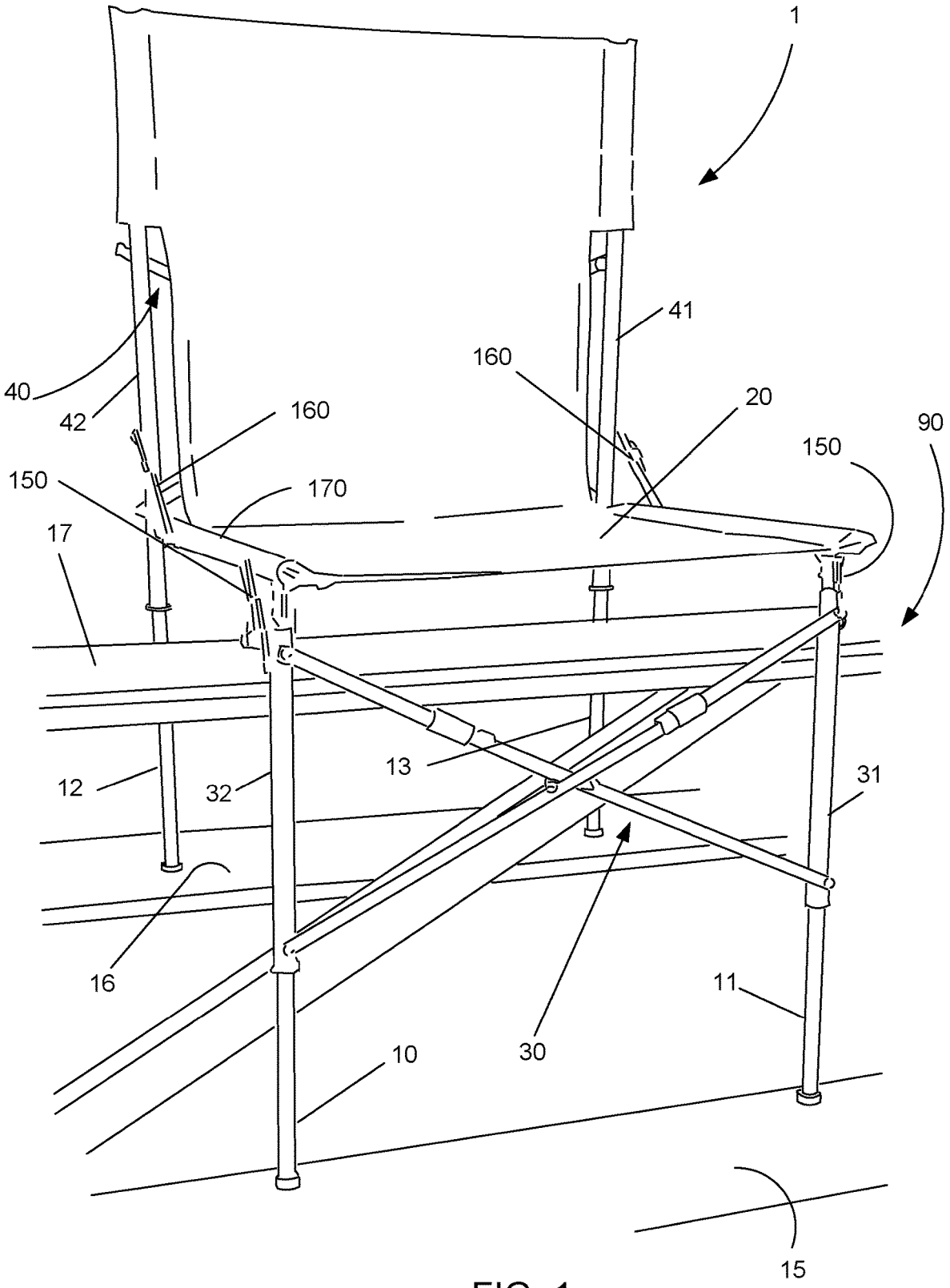
FIG. 1 shows a perspective view of a preferred chair.

FIG. 1 shows a preferred embodiment of the present invention. Foldable chair 1 is comfortably positioned on bleachers 90 and ready for use. Front adjustable legs 10 and 11 are resting on step 15. Back adjustable legs 12 and 13 are resting on step 16. Cloth seat rest 20 and back rest 21 are sewn around the metal frame of chair 1 as shown. Seat rest 20 is positioned a mere few inches over bench 17. Front foldable leg brace 30 is pivotally attached between front leg supports 31 and 32. Rear foldable leg brace 40 is pivotally attached between rear leg supports 41 and 42. The area under seat rest 20 is clear so that seat rest 20 can be positioned just slightly above bench 17. Therefore, in FIG. 1 a user is able to sit comfortable in chair 1 at a sitting level that is approximately equal to other spectators sitting on bench 17. Chair 1 is very stable and the user will not be obstructing the view of other spectators sitting behind him.

Figure 2:
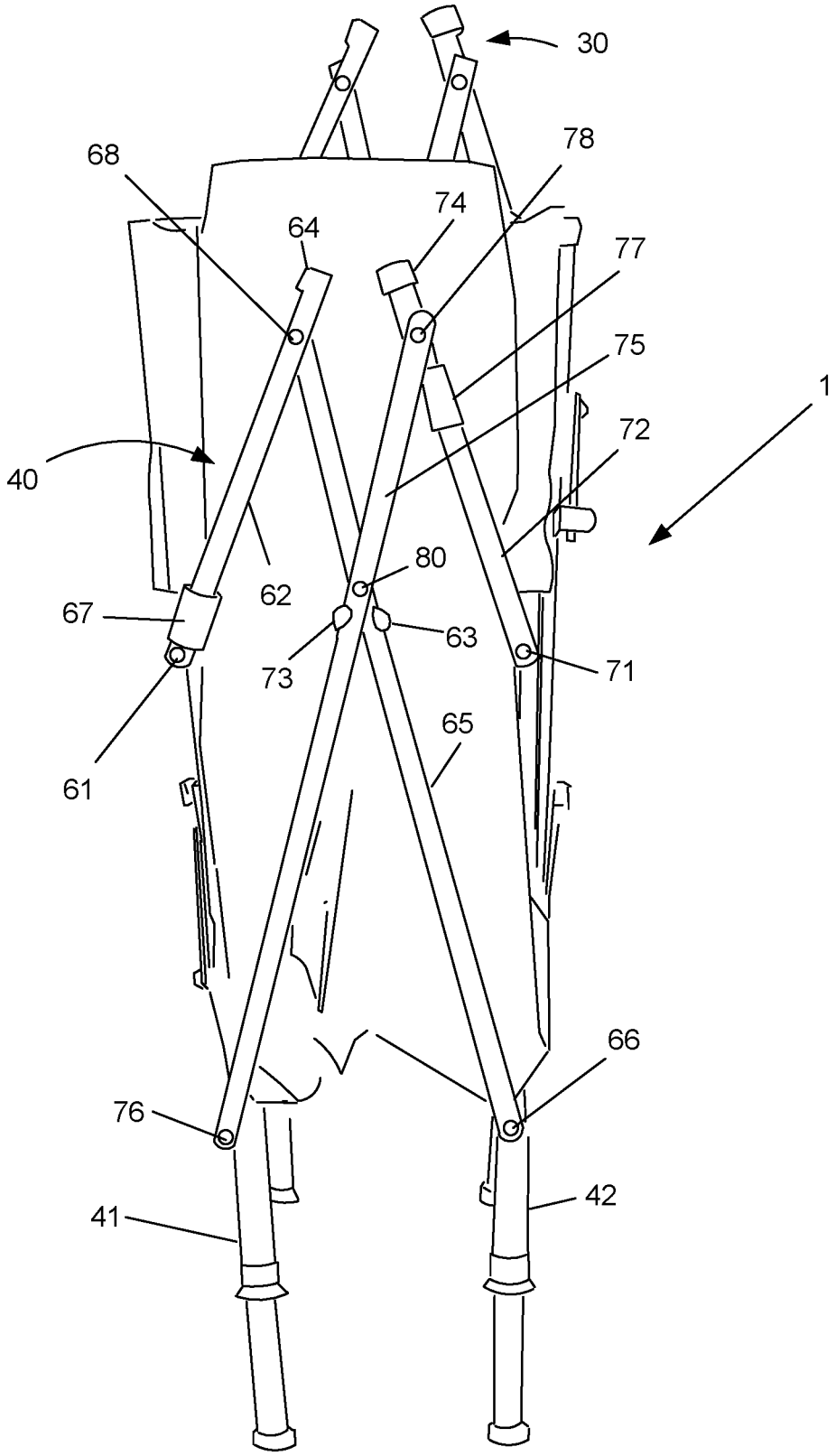
FIG. 2 shows a folded chair.

FIG. 2 shows a rear view of foldable chair 1 as it is folded and now easily carried for transport. Rear foldable leg brace 40 is shown folded and pivotally connected between rear leg supports 41 and 42. Pivot brace 62 includes stop 64 and is pivotally connected to leg support 41 at pivot connection 61. Slidable support 67 is connected to pivot brace 62 and is easily slid along brace 62 as needed. Pivot brace 62 is pivotally connected to pivot brace 65. Stop 63 is welded to pivot brace 65 and pivot brace 65 is pivotally connected to leg support 42 as shown at pivot connection 66. Likewise, pivot brace 72 includes stop 74 and is pivotally connected to leg support 42 at pivot connection 71. Slidable support 77 is connected to pivot brace 72 and is easily slid along brace 72 as needed. Pivot brace 72 is pivotally connected to pivot brace 75. Stop 73 is welded to pivot brace 75 and pivot brace 75 is pivotally connected to leg support 41 as shown at pivot connection 76. Pivot brace 65 and pivot brace 75 are pivotally connected to each other at pivot connection 80.

Figure 3:
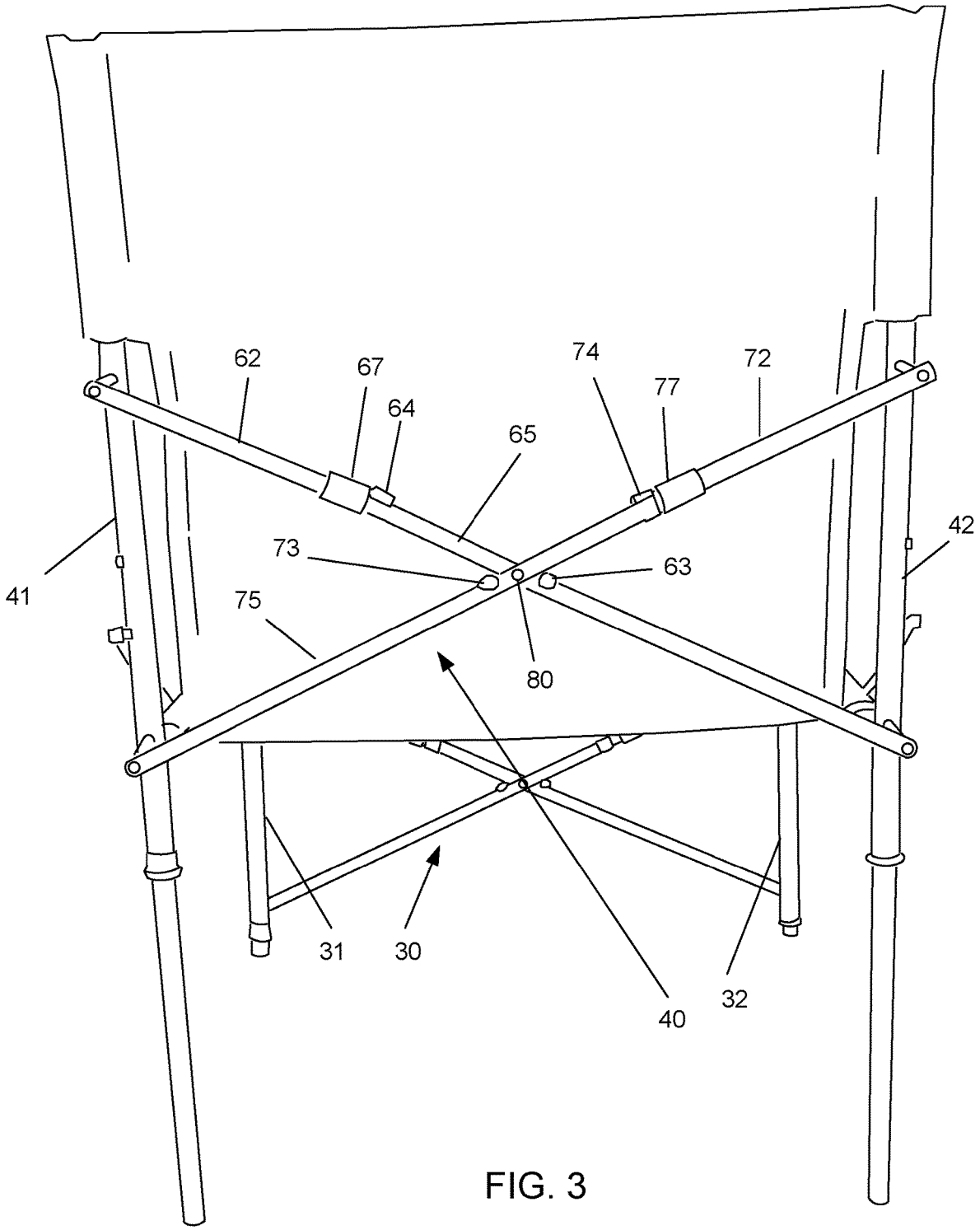
FIG. 3 shows a rear view of the chair.

In FIG. 3 the user has unfolded chair 1 and has braced it so that it is ready for use. Rear foldable leg brace 40 is stiff and locked in the position shown for optimum support. Pivot brace 62 is aligned with pivot brace 65. Stops 63 and 64 function to hold pivot braces 62 and 65 in a straight line. Slidable lock 67 has been slid downward and covers pivot brace 62 and pivot brace 65 so that they are held together in the straight line shown. When the user is ready to fold the chair back up, he will slide slidable lock 67 upwards and fold the chair so that it appears as shown in FIG. 2. Likewise, pivot brace 72 is aligned with pivot brace 75. Stops 73 and 74 function to hold pivot braces 72 and 75 in a straight line. Slidable lock 77 has been slid downward and covers pivot brace 72 and pivot brace 75 so that they are held together in the straight line shown. When the user is ready to fold the chair back up, he will slide slidable lock 77 upwards and fold the chair so that it appears as shown in FIG. 2.

In a similar fashion, FIG. 2 shows front foldable leg brace 30 unfolded and in a locked position between front leg supports 31 and 32. In a preferred embodiment, front foldable leg brace 30 includes components similar to rear foldable leg brace 40 and is locked is a similar fashion to provide stiff, strong structural support between front leg supports 31 and 32.

Figure 4:
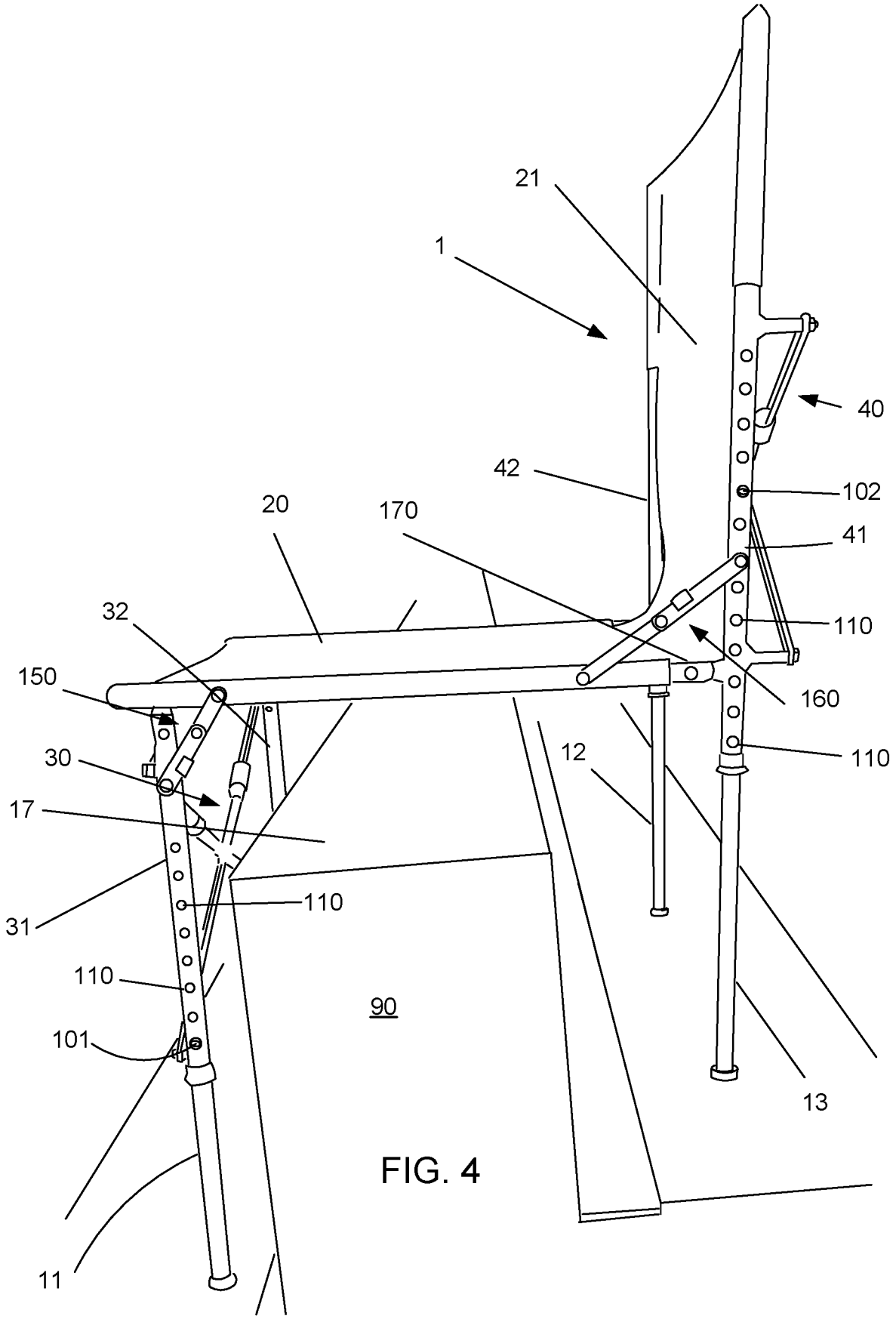
FIG. 4 shows a perspective side view of the chair.

FIG. 4 shows a perspective side view of chair 1 shown in FIG. 1 positioned over bleachers 90. Each leg support 41, 42, 31 and 32 includes a plurality of holes 110 to receive spring-loaded push buttons for the purpose of locking legs 10, 11, 12 and 13 into place. For example FIG. 2 shows push button 101 inserted through a hole 110 locking leg 11 into place. Also, push button 102 is inserted through a hole 110 locking leg 13 into place.

Figure 5:
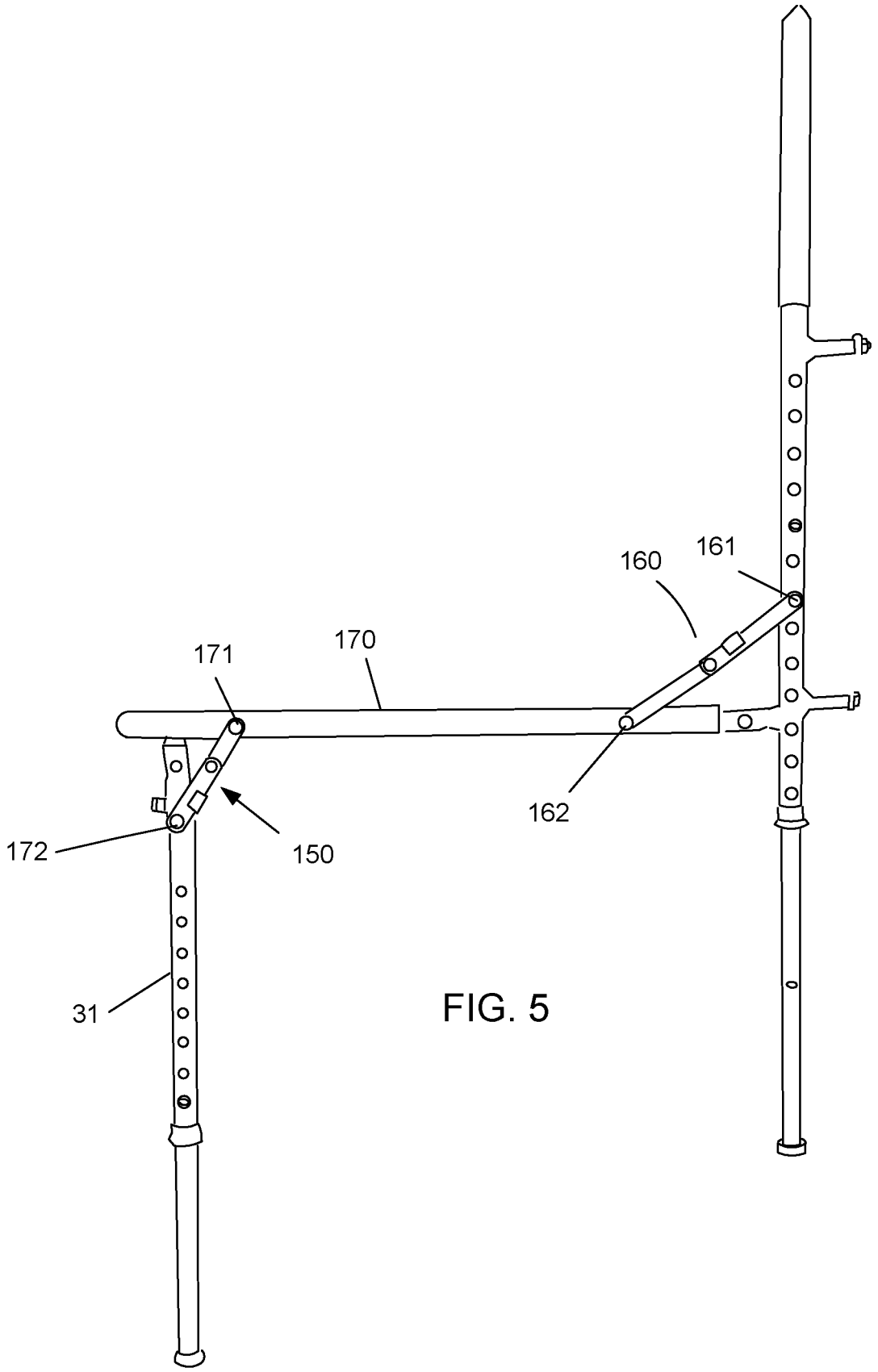
FIGS. 5 and 6 show the folding of the front leg supports and rear leg supports.
Figure 6:
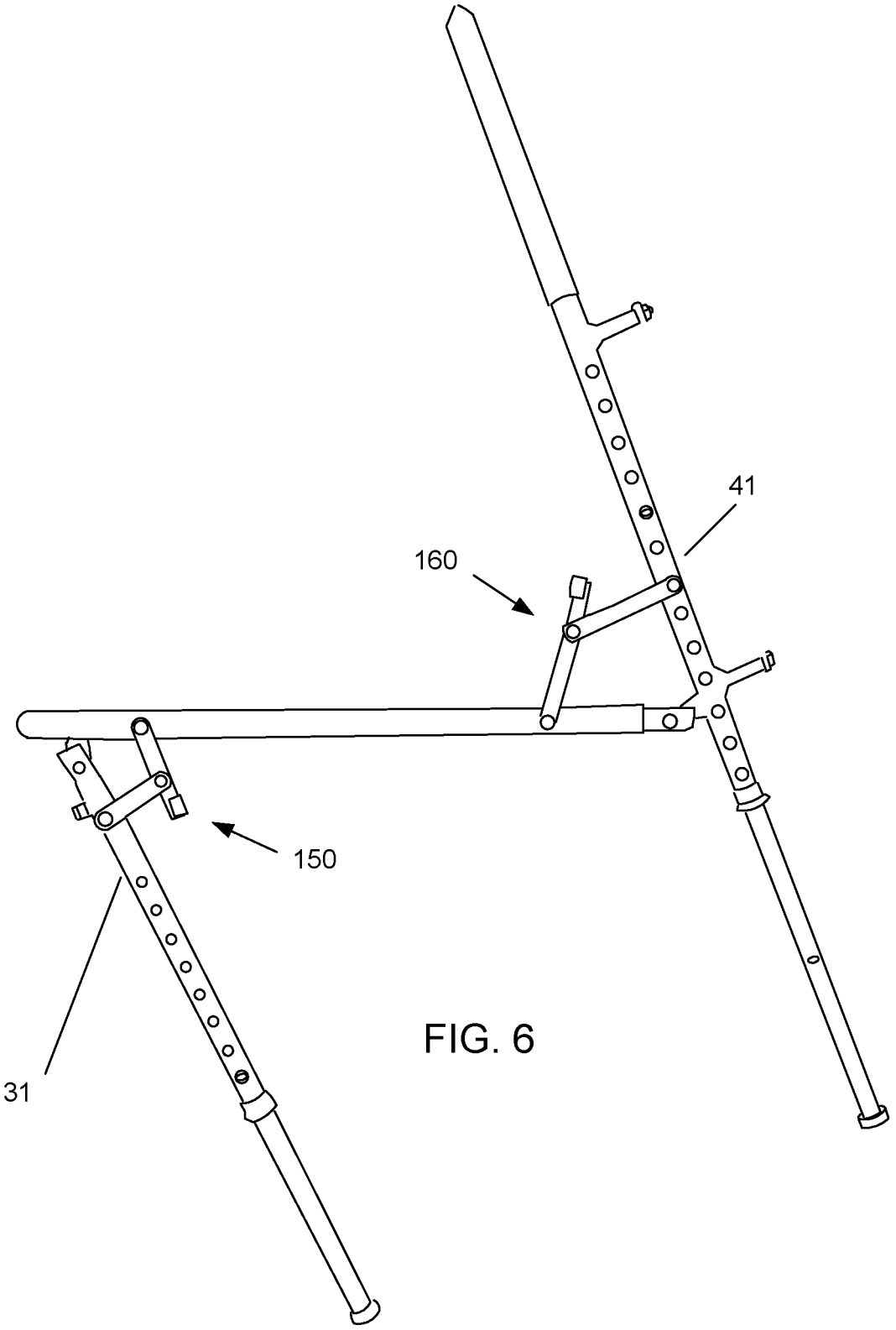

FIGS. 5 and 6 illustrate the operation of front leg locking bars 150 and rear legs locking bar 160. For example, in FIG. 5, front leg locking bar 150 is shown pivotally connected to side seat frame 170 at pivot connection 171 and pivotally connected to front leg support 31 at pivot connection 172. Also rear leg locking bar 160 is shown pivotally connected to rear leg support 41 at pivot connection 161 and pivotally connected to side seat frame 170 at pivot connection 162.

FIG. 6 shows the process of folding chair 1 to put it in the position shown in FIG. 2 for stowage or transport. The user has pushed front leg supports 31 and 32 counterclockwise causing locking bar 150 to collapse as shown. The user has also pushed rear leg supports 41 and 42 counterclockwise causing locking bar 160 to collapse as shown.

Utilization of the Chair

Bleacher Seating

Figure 7:
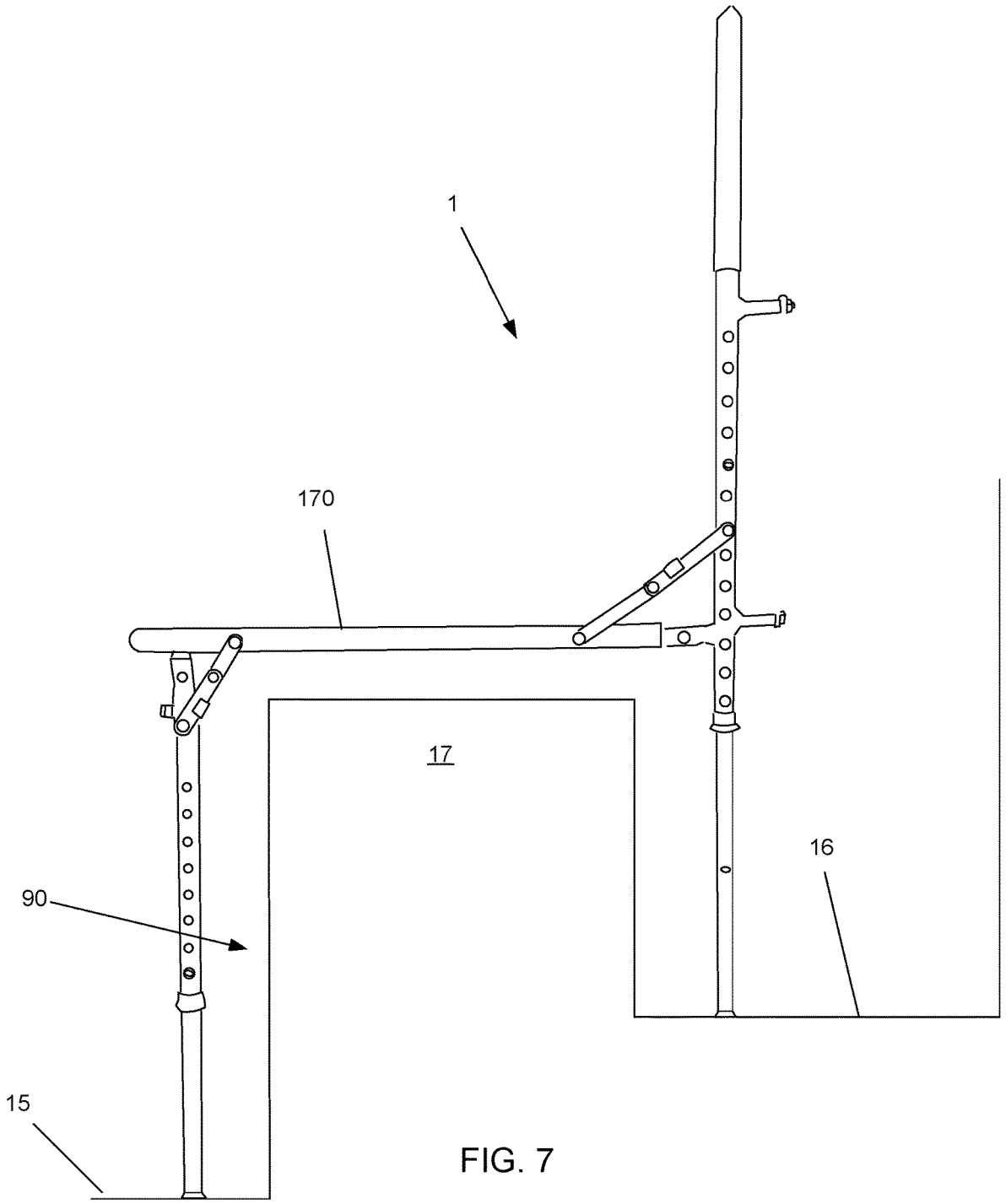
FIG. 7 shows the chair utilized for bleacher seating.

An exemplary feature of chair 1 is its ability to be versatile. For example, FIG. 7 shows a side view of chair 1 shown earlier in FIGS. 1 and 4. Seat frame 170 is positioned a mere few inches over bench 17 of bleachers 90. It should be noted that foldable leg brace 30 (FIG. 1) is positioned between front leg supports 31 and 32. Also rear foldable leg brace 40 is positioned between rear leg supports 41 and 42. Since there is no bracing on the sides between the front legs and the rear legs, this space is open. Therefore, seat frame 170 and seat 20 can be positioned so that it is only slightly above bench 17, as shown in FIGS. 1, 4 and 7.

Concrete Seating

Figure 8:
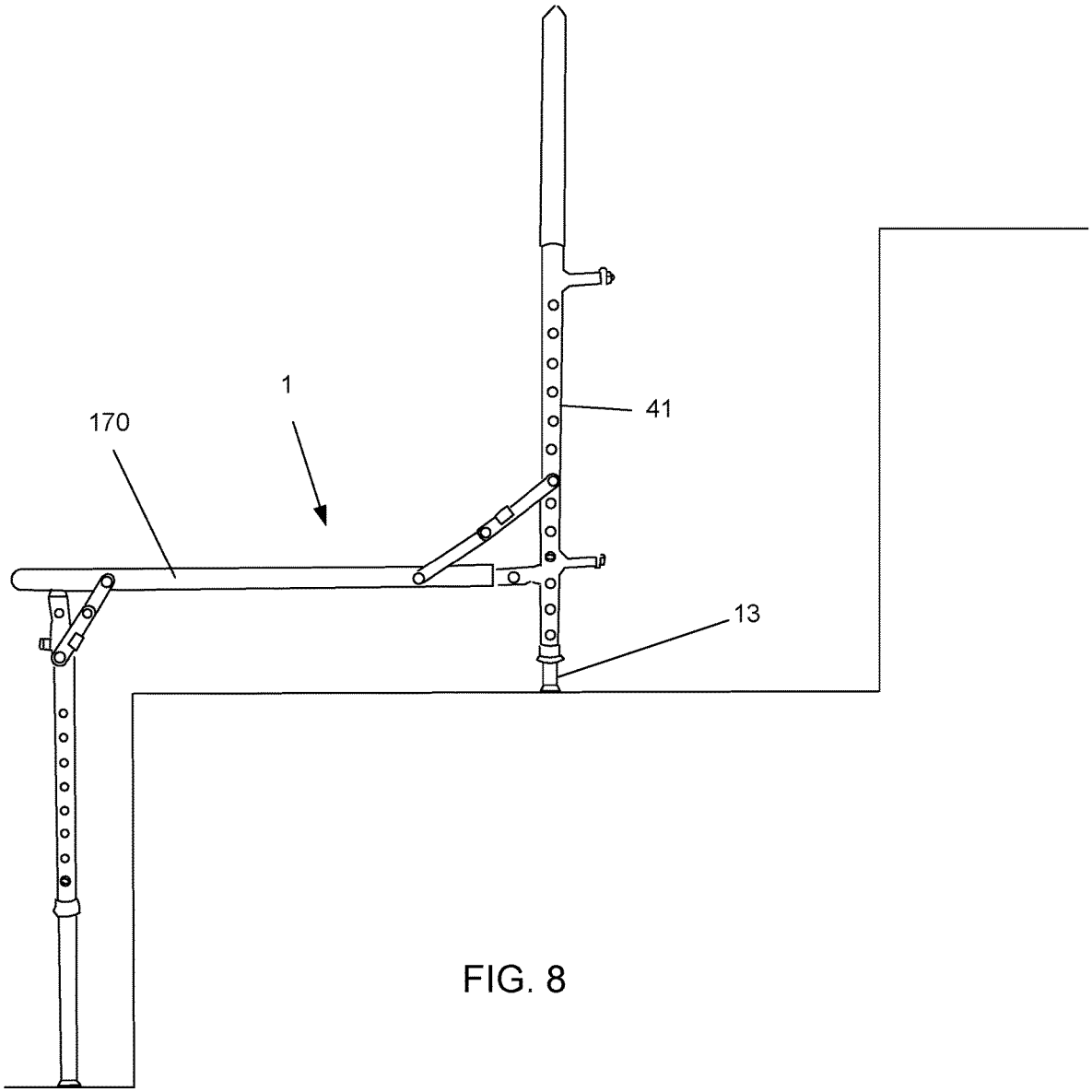
FIG. 8 shows the chair utilized for concrete stadium seating.

In FIG. 8 the user has adjusted chair 1 so that it provides comfortable seating for a stadium having concrete seats 203. Rear leg supports 41 and 42 extend only slightly below seat frame 170 so that the majority of the lengths of rear leg supports 41 and 42 are above seat frame 170. In a preferred embodiment rear leg supports 41 and 42 extend four inches below seat frame 170. This allows for the adjustment of rear legs 13 and 12 so that they are very short. It should be noted that preferably rear foldable leg brace 40 is positioned so that a majority of it is above seat frame 170 and seat 20 (FIG. 4). This allows chair 1 to be useable on for concrete seating such as is shown in FIG. 8.

Uneven Surface

Figure 9:
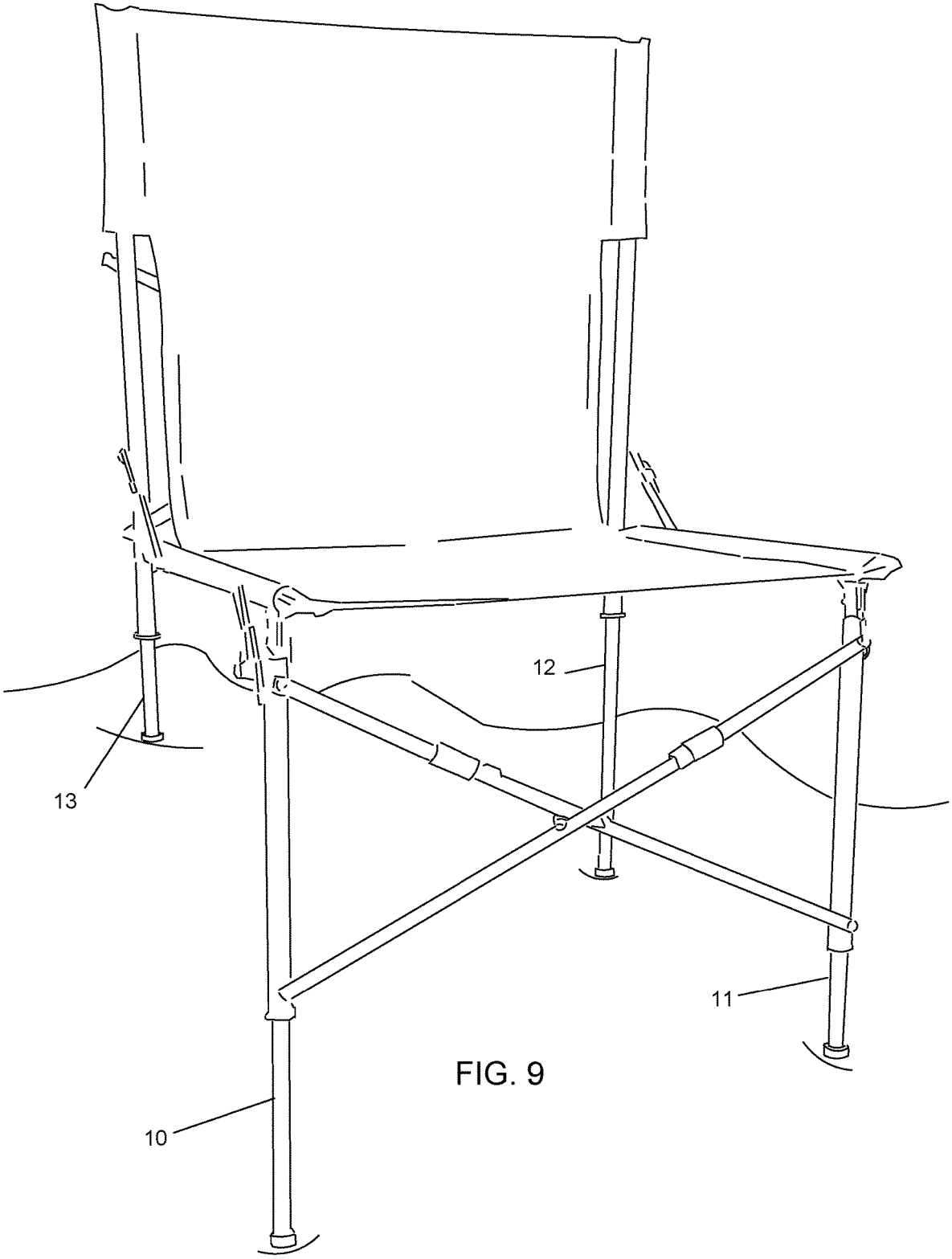
FIG. 9 shows the chair on an uneven surface.

Each leg of chair 1 is independently adjustable so that its length can be locked in a position preferred by the user. This enables chair 1 to be positionable on and uneven surface so that seat 20 is flat and comfortable for the user. For example, FIG. 9 shows chair 1 on an uneven surface. Each leg 10, 11, 12 and 13 has been adjusted according the appropriate height.

Steady Slope

Figure 10:
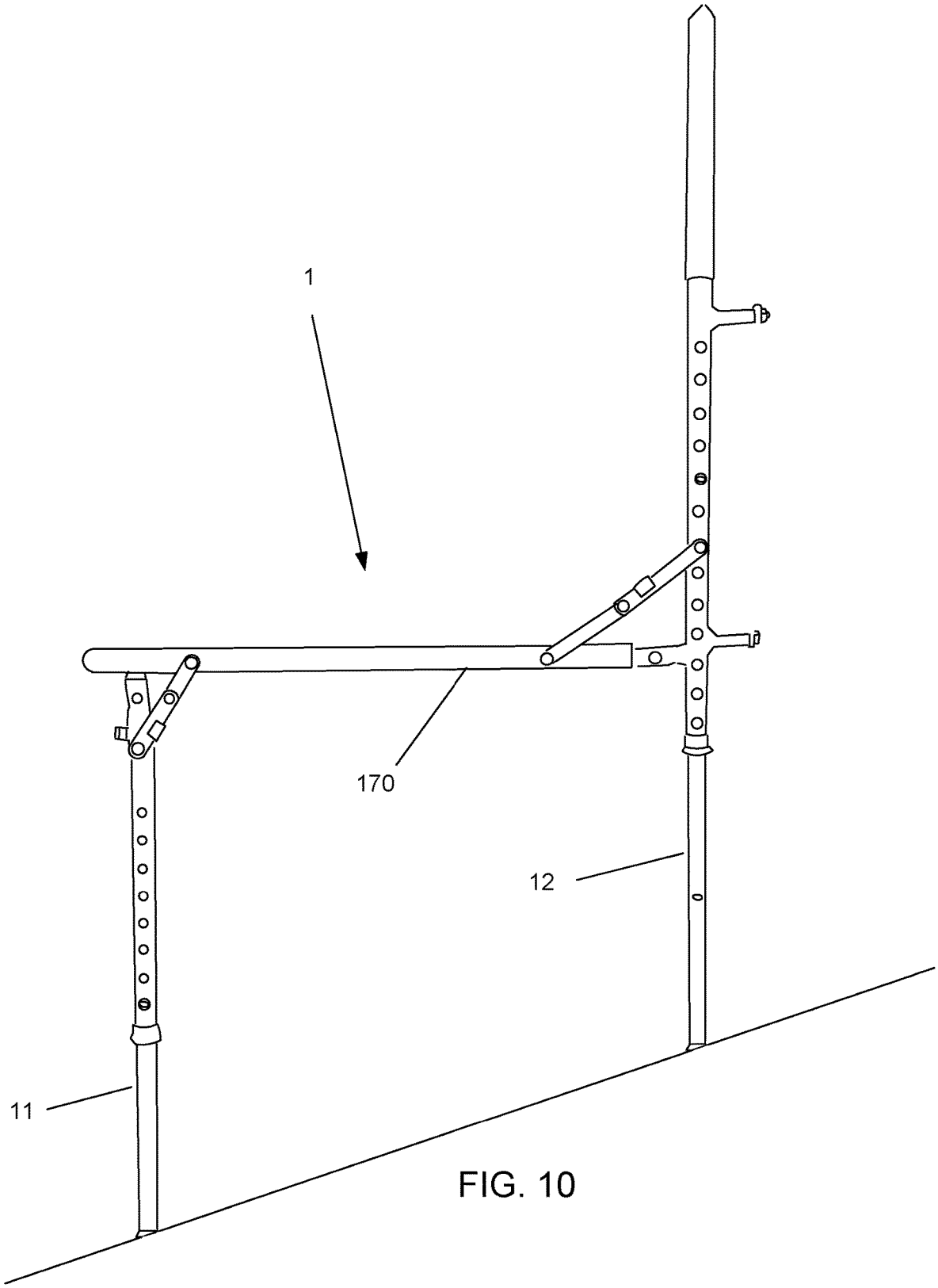
FIG. 10 shows the chair on a slope.

In FIG. 10, chair 1 has been placed on a steady slope. Rear legs 12 and 13 and front legs 10 and 11 have been adjusted to the appropriate heights so that seat frame 170 and seat 20 are flat.

Flat Surface

Figure 11:
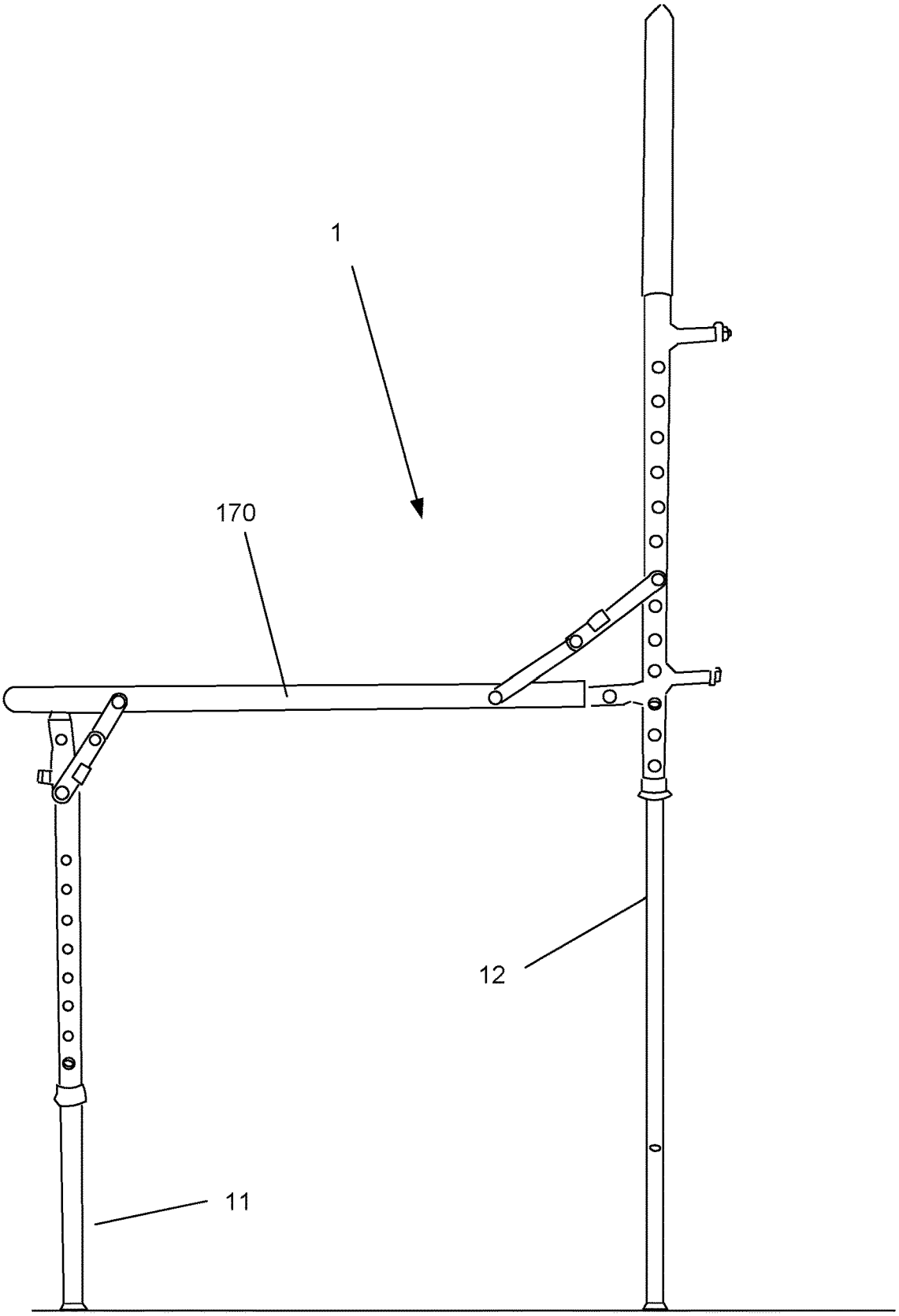
FIG. 11 shows the chair on a flat surface.

In FIG. 11, chair 1 has been placed on a flat surface. Rear legs 12 and 13 and front legs 10 and 11 have been adjusted to the appropriate heights so that seat frame 170 and seat 20 are flat.

What is claimed is:

1. A portable, folding chair, comprising:

A. a seat frame,

B. two front leg supports pivotally connected to said seat frame, and extending downward from said seat frame, C. two rear leg supports pivotally connected to said seat frame, wherein a majority of the length of each of said two rear leg supports is above said seat frame, D. two individually adjustable front legs each extending downward from said two front leg supports, E. two individually adjustable rear legs each extending downward from said two rear leg supports, F. a front foldable leg brace connected between said two front leg supports, and G. only one rear foldable leg brace connected between said two rear leg supports, wherein said only one rear foldable leg brace is positioned above said seat frame, wherein there is no rear leg brace positioned below said seat frame, wherein there is no brace support between said front legs and said rear legs thereby creating an open space under said seat frame to permit bleacher seating and concrete seating.

2. The portable, folding chair as in claim 1, further comprising a cloth seat and back rest sewn around said seat frame and said two rear leg supports.

3. The portable, folding chair of claim 1, wherein an area under said seat frame is clear from components of said portable, folding chair to allow positioning of said portable, folding chair over a bleacher bench.

4. The portable, folding chair of claim 1, wherein each said front leg is slidingly inserted into each said front leg support and locked into position utilizing a spring loaded push button.

5. The portable, folding chair of claim 1, wherein each said rear leg is slidingly inserted into each said rear leg support and locked into position utilizing a spring loaded push button.

6. The portable, folding chair of claim 1, wherein said two rear leg supports extend below said seat frame no more than approximately 5 inches and said two front leg supports extend below said seat frame at least twice the distance of said two rear leg supports to permit concrete seating.

7. The portable, folding chair of claim 1, wherein said two rear leg supports extend below said seat frame a distance shorter than at least half the distance that said front leg supports extend below said seat frame to permit concrete seating.

8. The portable, folding chair as in claim 1, wherein said portable, folding chair is utilized for bleacher seating.

9. The portable folding chair as in claim 1, wherein said portable, folding chair is utilized for concrete seating.

10. The portable folding chair as in claim 1, wherein said portable, folding chair is utilized for slope seating.

11. The portable folding chair as in claim 1, wherein said portable, folding chair is utilized for seating on a flat surface.

12. The portable folding chair as in claim 1, wherein said portable, folding chair is utilized for seating on an uneven surface.

13. A portable, folding chair, comprising:

A. a seat frame,

B. two front leg supports pivotally connected to said seat frame, and extending downward from said seat frame, C. two rear leg supports pivotally connected to said seat frame, wherein a majority of the length of each of said two rear leg supports is above said seat frame, D. two individually adjustable front legs each extending downward from said two front leg supports, E. two individually adjustable rear legs each extending downward from said two rear leg supports, F. a front foldable leg brace connected between said two front leg supports, and G. only one rear foldable leg brace connected between said two rear leg supports, wherein said only one rear foldable leg brace is positioned above said seat frame, wherein there is no rear leg brace positioned below said seat frame, wherein there is no brace support between said front legs and said rear legs so as to create an open space under said seat frame to permit bleacher seating, wherein said two rear leg supports are extended below said seat frame a distance that is at least twice as short as the distance said front leg supports extend below said seat frame so as to permit concrete seating.

* * * * *